United States Patent [19]

Gurevich

[11] Patent Number: 4,873,506

[45] Date of Patent: Oct. 10, 1989

[54] METALLO-ORGANIC FILM FRACTIONAL AMPERE FUSES AND METHOD OF MAKING

[75] Inventor: Leon Gurevich, St. Louis, Mo.

[73] Assignee: Cooper Industries, Inc., Houston, Tex.

[21] Appl. No.: 166,082

[22] Filed: Mar. 9, 1988

[51] Int. Cl.[4] ..... H01H 35/04; H01H 69/02

[52] U.S. Cl. ..... 337/290; 337/297; 29/623

[58] Field of Search ..... 337/297, 290, 415, 255; 29/623

[56] References Cited

U.S. PATENT DOCUMENTS

| | | | |
|---|---|---|---|
| 4,208,645 | 6/1980 | Harmon et al. | 337/415 |
| 4,272,753 | 6/1981 | Nicolay | 337/297 |
| 4,306,213 | 12/1981 | Rose | 337/297 |
| 4,460,888 | 7/1984 | Gratton et al. | 337/297 |
| 4,751,489 | 6/1988 | Spaunhorst | 337/255 |

*Primary Examiner*—H. Broome

*Attorney, Agent, or Firm*—Nelson A. Blish; Eddie E. Scott; Alan R. Thiele

[57] ABSTRACT

A fractional amp fuse (10) with a thin film fusible element (16) connecting thick film pads (14) supported by a polished insulating substrate (12). The fuse subassembly has leads (24) attached by resistance welding and is encapsulated in a ceramic insulating material (18). The entire fuse is enclosed in a plastic-like material (20).

14 Claims, 3 Drawing Sheets

METALLO-ORGANIC FILM FRACTIONAL AMPERE FUSES AND METHOD OF MAKING

BACKGROUND OF THE INVENTION

This invention relates to fractional and low ampere fuses using metallo-organic thin film ink as a fuse link and to a method of making these fuses.

Microfuses are used primarily in printed circuits and are required to be physically small. It is frequently necessary to provide fuses designed to interrupt surge currents in a very short period of time and at very small currents. For example, to limit potentially damaging surges in semiconductor devices, it is often necessary to have a low ampere fuse which interrupts in a time period of less than 0.001 seconds at ten times rated current, in order to limit the energy delivered to the components in series with the fuse.

Previous attempts to provide fuses operating in this range have utilized thin wires with a diameter of less than approximately 1 mil (1/1000 inch). The use of small diameter wire for fuse elements has a number of problems related to present manufacturing technology. One such problem is the high manufacturing cost for a thin wire microfuse. Since the fusible element has such a small diameter, the fusible element must be manually attached to the lead wires or end caps.

If solder and flux are used to attach the fusible wire element, it is difficult, in such a small device, to prevent the solder used to attach the wire ends from migrating down the wire during the manufacturing process. This solder migration causes a change in the fuse rating. In addition, the fuse rating may be changed when the external leads are soldered onto a printed circuit board since the heat generated in these processes can melt and reflow the solder inside the fuse. This also changes the fuse rating.

Another problem in manufacturing microfuses is the difficulty of coating the small diameter wire when encapsulating the fuse, as described in U.S. Pat. No. 4,612,529, so that arc quenching material, such as ceramic filler, surrounds the wire.

Methods of making fuses without wires as the fusible link are known. For example, McGalliard, U.S. Pat. No. 4,296,398, discusses forming a plurality of fuse elements by etch-resistant photography, silk screening, stamping or bonding. This technique, which is known as thick film printing, forms a layer of metal typically one half to one mil thick and suffers from several drawbacks. For example, the drying time for thick film prior to firing increases the manufacturing costs. Also, the width of the fusible element required to achieve low amperage ratings may be such that heat cannot properly be dissipated through the substrate during steady state operation. The typical thick film has limitation of thickness at about 0.5 mil thick, see for example, Ragan, U.S. Pat. No. 3,401,452. Thick film printing can achieve lines as narrow as 3 mil wide. Thus, it is not possible to produce fractional amp fuses with thick film elements due to the thickness and width limitations, i.e., the cross sectional area of the thick film is limited to 1.5 square mils, which will not melt at 1 amp or less.

Another method of making fuses is discussed in an article by Horiguchi, et al in *IEEE Transactions On Parts Hybrid and Packaging,* Volume PHP-13 No. 4, December, 1977. The fuse discussed comprises two layers, the first being an organic film, and the second, a nickel chromium film. This is a complicated manufacturing procedure in that evacuation is required for deposition of both for the organic layer and the metal layer and would add to the manufacturing cost. In this fuse construction, the organic film melts and damages the conductive layer, causing the fuse to open.

SUMMARY OF THE INVENTION

This invention provides a new fractional ampere fuse and method of manufacturing low ampere fuses, utilizing metallo-organic thin film technology. The ends of polished, insulating substrate such as glass, ceramic, or other suitable material, are metallized. A fusible element is printed on the substrate, using metallo-organic ink, connecting and overlapping the metallized ends, with a screen printing process. The substrate is slowly heated at a rate between approximately 2°–15° C. per minute and maintained at a temperature approximately 500° C. to 900° C. for approximately one hour. The fuse may be coated with ceramic adhesive or other suitable encapsulating material.

DETAILED DESCRIPTION OF THE DRAWINGS

Figure 1:
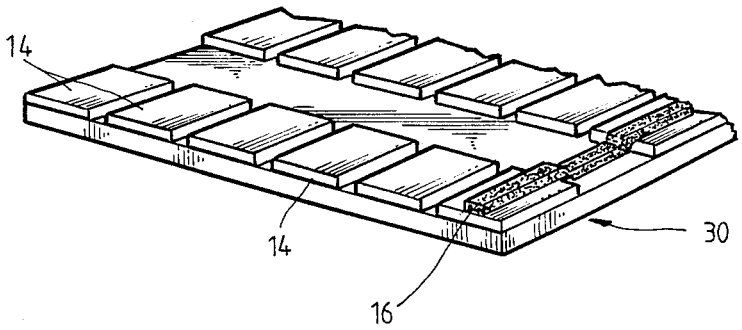
FIG. 1 is a perspective view of a segment of an insulating plate used in the making of microfuse substrates.
Figure 2:
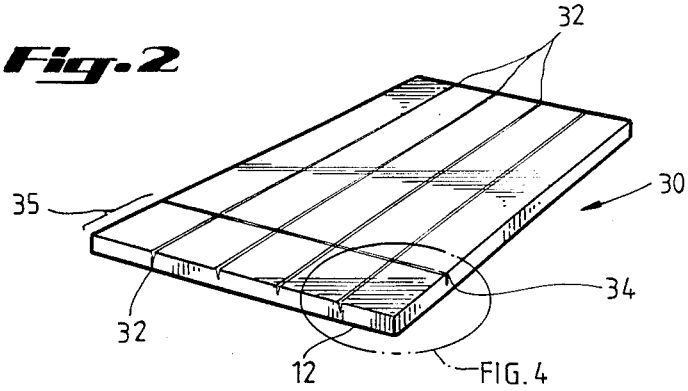
FIG. 2 is a perspective view of a plate used in the making of microfuse substrates which has been scored.

Manufacturing a fuse according to the present invention begins with providing a plate or substrate or other support means of insulating material shown in FIGS. 1 and 2. Ceramic is the material of choice in the present invention. However, since high arcing temperatures would not be a problem for these low amperage microfuses, and since the heat treatment manufacturing is relatively low, it is not necessary that high temperature insulating material such as ceramic be used. It is important that the insulating material not carbonize at fuse operating temperatures since this would support electrical conduction. Other suitable plate materials would include glasses such as borosilicate glass and ceramics such as alumina, berrillia, magnesia, zirconia and forsterite.

The insulating material will preferably have polished surfaces with a finish better than 80 to 120 micro inches ($10^{-6}$). Since the thickness of the finished fuse link will be on the order of 1–100 micro inches, a polished substrate is necessary for consistent fuse element thickness, and hence repeatable characteristics in the finished product. Over glazing is another way of producing smooth surface finishes Another important property of plate 30 is that it have good dielectric strength so that no conduction occurs through plate 30 during fuse interruption. Once again, the ceramic polycrystalline materials discussed above have good dielectric strength in addition to their thermal insulating qualities.

Plate 30 is printed, using a screen printing process or similar process, with thick film ink, as is well known in the industry. In this process, a screen having openings corresponding to the desired pattern is laid over plate 30. Ink is forced through the openings onto the plate to provide a pattern of metallized areas or pads 14 which will later serve for attachment of lead wires and fusible elements. The ink that is used to form pads 14 is a silver based composition. In one embodiment, a silver, thick film ink is used. Other suitable materials for the metallized areas are thick film ink based on copper, nickel, gold, aluminum, palladium, platinum, combinations thereof and other conductive materials.

Pads 14 may be placed on plate 30 by other methods than printing. For example, metallized pads may be attached to plate 30 by a lamination process. Another alternative would be to provide pads on plate 30 by vaporized deposition through techniques using sputtering, thermal evaporation or electron beam evaporation. Such techniques are well known in the art.

After the pattern of metallized ink rectangles or pads are printed on plate 30, the plate is dried and fired. A typical drying and firing process would be to pass plate 30 through a drying oven on a conveyor belt where drying takes place at approximately 150° C. and firing takes place at approximately 850° C. The drying process drives off organics and the firing process sinters and adheres the pads to plate 30.

The pads laid down on plate 30 by the printing process are approximately 0.0005" thick after firing. Pads of various geometry and thicknesses may be used depending on various factors such as conductivity of the metallized pad and width and length of the pad.

A thin film fuse link 16 is printed onto plate 30 so that it overlays and connects two of the metallized areas 14. The thin film fuse link 16 may be screen printed as described above or painted, sprayed, brushed, or otherwise placed on plate 30 by such means as are well-known in the art. Although the sequence described has the pads 30 printed first and the fusible element 16 printed second, this order could be reversed, or the pads 30 and fuse element could be printed simultaneously.

Unlike thick film inks, the ink is not a mixture of metal powder with organic materials, but a chemically linked metal and resin, normally made of an oxygen, a sulphur, a nitrogen or phosphorous atom which is attached to a carbon and metal atom. These inks are -readily. available and the manufacturing company specifies heat-up rates and. temperatures depending on the composition of the metallo-organic ink.

Metallo-organic deposition is a process of depositing thin film of metals or their compounds on substrates by thermal decomposition of metallo-organics. There is a noted difference between organo metallics that can be used in chemical vapor deposition. In the case of organo metallics, the metal atom is directly bonded to one or more carbon atoms, while with metallo-organics, the metal atom is linked to an oxygen, a sulphur, a nitrogen or phosphorus atom which in turn is attached to one or more carbon atoms. So the main difference is that organo-metallic is formulated with the metal atom directly connected to the carbon atom. While in metallo-organic, the metal atom is not connected to carbon directly, but instead using other atoms, such as $O_2$, N, P to make links with carbon. In general, metallo-organic contains more carbon than organo-metallics.

The main advantages of metallo-organics are compared to the vacuum deposition method less, expensive equipment and no skill personnel are necessary for the process; the metallo-organic may be mixed with photopolymers and photographically generated into any desired pattern to the width as small as 2–3 microns; due to large coverage for the same volume, the metallo-organic films are considerably cheaper than those made from the conventional thick film pastes; and, the film of metallo-organic composition usually contains less than 1% of residual carbon, which does not affect the fuse application.

Plate 30 is again fired. The resulting thickness of fired metallo-organic films are on the order of 1–100 micro inches. Materials such as gold, silver, palladium, nickel are available in metallo-organic inks. Other conductive metallo-organic ink would also be suitable. A metallo-organic ink can be selected to provide a resistance range within a sheet resistivity of 100–1000 milliohms per square/mil.

Fired element composition generally is 98% pure metal and less than 1% carbon The width of fusible element 16 that can be produced by printing is about 3 mils. Photolithography and etching can produce lines as narrow as 0.08–0.12 mils.

Figure 3:
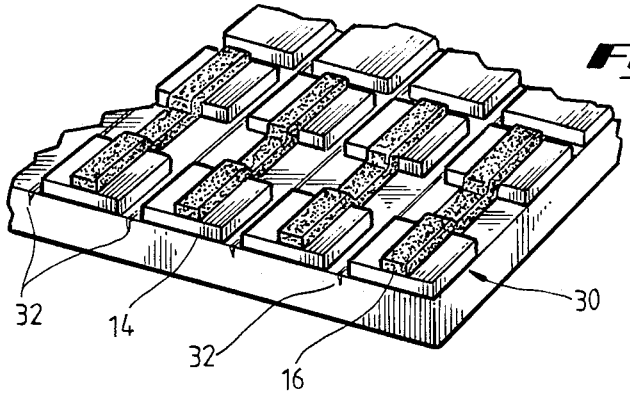
FIG. 3 is a perspective view of an enlarged portion of the detail shown in FIG. 2 after printing and scoring.

Plate 30 in the preferred embodiment is about 2½" square and approximately 0.015" to 0.025" thick. After firing, the plate is subdivided into chips or substrates by scoring longitudinally 32 and horizontally 34 as shown in FIGS. 2 and 3. The number of resulting chips will vary according to chip size. Score marks may be made by any suitable means known in the art such as scribing with a diamond stylis; dicing with a diamond impregnated blade, or other suitable abrasive; scribing with a laser; or cutting with a high pressure water jet. The scribe marks should not completely penetrate plate 30, but only establish a fault line so that plate 30 may be broken into rows 35 and later into individual chips 12 by snapping apart or breaking. In the preferred embodiment, dicing with a diamond impregnated blade is used.

In an alternate embodiment, the plate is fabricated with score lines preformed. In the case of a ceramic substrate, the ceramic is formed in the green state with intersecting grooves on the surface and then fired.

Figure 4:
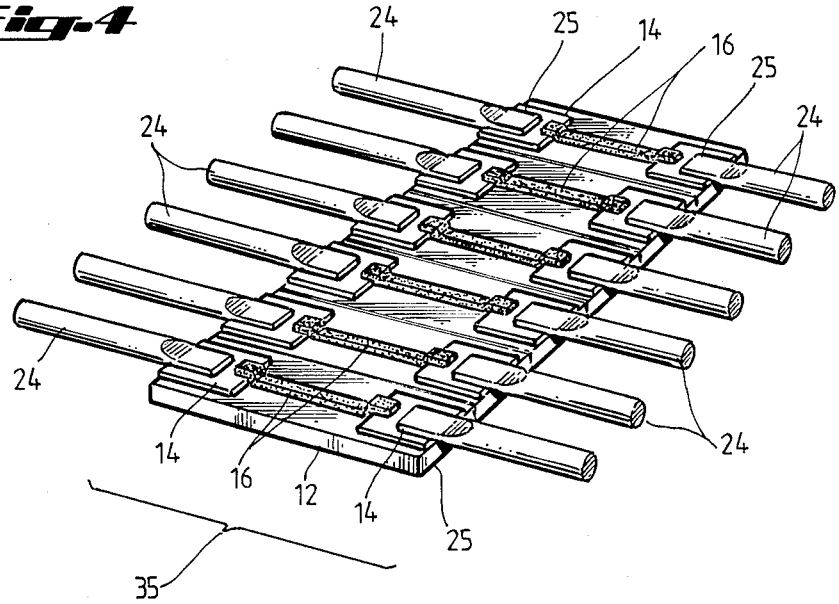
FIG. 4 is a perspective view of a row of microfuse substrates with lead wires attached.

A row 35 of chips is snapped off as is shown in FIG. 4. This row of chips then has lead wires attached at each end of chip 12 by resistance welding with the fuse wires mounted in an axial configuration. Resistance welding is a process where current is forced through the lead wire 24 to heat the wire such that bonding of the lead wire to pad 14 is accomplished. Parallel gap resistance welders of this type are well known in the art and are available from corporations such as Hughes Aircraft which is a subsidiary of General Motors. Lead wires 24 have a flattened section 25 which provides a larger area of contact between lead wire 24 and pads 14. The end of lead wire 24 may be formed with an offset in order to properly center substrates or fuse elements in the fuse body.

Each individual fuse assembly, comprising chip 12, pads 14, fusible element 16 and lead wires 24, is broken off from row 35 one at a time and coated or covered with an arc quenching material or insulating material, such as ceramic adhesive 18. This may be performed by dipping, spraying, dispensing, etc. Other suitable coatings include, but are not limited to, other high temperature ceramic coatings or glass. This insulating coating absorbs the plasma created by circuit interruption and decreases the temperature thereof. Ceramic coatings limit the channel created by the vaporization of the fusible conductor to a small volume. This volume, since it is small, is subject to high pressure. This pressure will improve fuse performance by decreasing the time necessary to quench the arc. The ceramic coating also improves performance by increasing arc resistance through arc cooling.

In the preferred embodiment, the fuse assembly is coated on one side and the coating material completely covers the fusible element 16, pads 14, one sides of chip 12, and the attached ends of leads 24. However, the invention may be practiced by covering a portion of the fuse assembly with ceramic adhesive 18. Covering a portion of the fuse assembly is intended to include coating a small percent of the surface area of one or more of the individual components, up to and including one hundred percent of the surface area. For example, the fusible element 16 may be coated, but not the pads 14 or leads 24.

Figure 5:
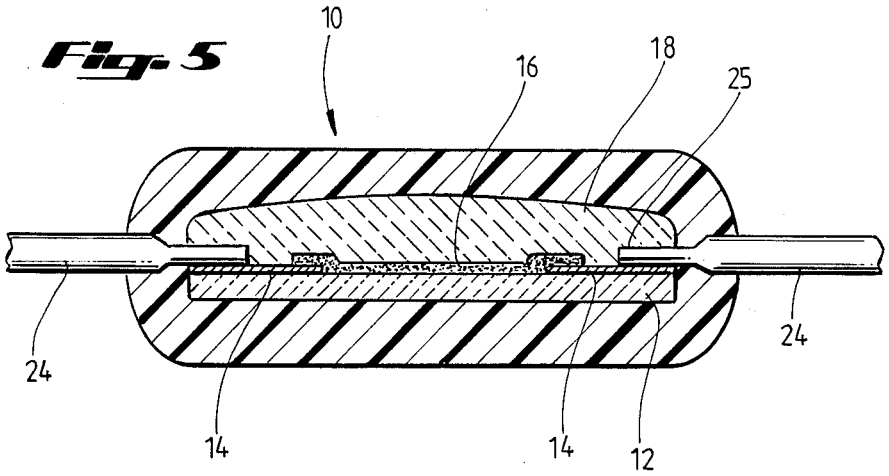
FIG. 5 is a cross sectional view of an axial microfuse according to the present invention.

The coated fuse assembly is next inserted into a mold and covered with plastic, epoxy or other suitable material in an injection molding process or other well-known processes. Plastic body 20 may be made from several molding materials such as Ryton R-10 available from Phillips Chemical Company. FIG. 5 shows a cross sectional view of an axial microfuse after having been enclosed in a molded plastic body.

Figure 6:
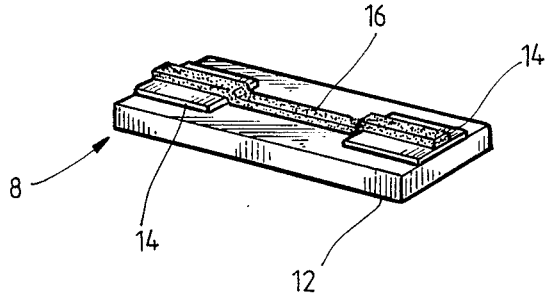
FIG. 6 is a perspective view, of a microfuse according to the invention prior to encapsulation.

FIG. 6 shows another embodiment in which a fuse element subassembly 8 is comprised of a substrate 12, fusible element 16, and metallized pads 14. In this simplified package, fuse subassembly 8 may be incorporated directly into a variety of products by other manufacturers when constructing circuit boards. Attachment of leads may then be in a manner deemed most appropriate by the subsequent manufacturer and encapsulated with the entire circuit board, with or without a ceramic coating as needed. Fuse element subassemblies 8 may be connected in parallel or in series to achieve desired performance characteristics.

Figure 7:
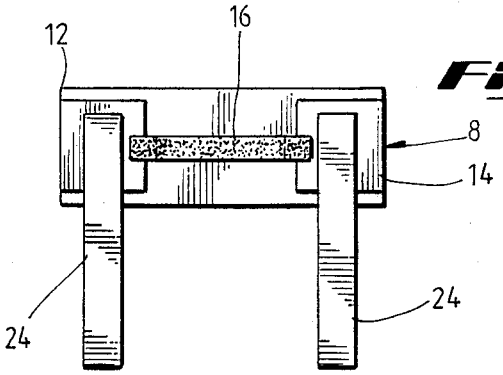
FIG. 7 is a plan view from the top of a fuse element subassembly with leads attached in a radial direction.
Figure 8:
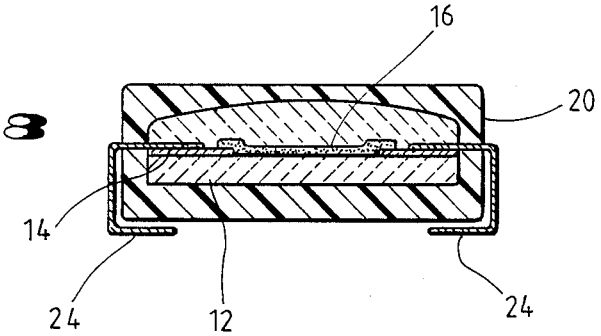
FIG. 8 is a cross sectional view of the fuse according to the present invention with leads attached in a manner suitable for surface mounting.

FIGS. 7 and 8 show alternate methods for attaching leads 24 to a subassembly 8. In FIG. 7, the leads are attached in a configuration known as a radial fuse and in FIG. 8 the leads are attached in a manner suitable for use as a surface mount fuse. The manufacturing steps described for the axial embodiment of this invention are basically the same for the radial and surface mount embodiments with some steps performed in different sequence. The lead wire shape and orientation, and the plastic body shape and size can be varied to meet different package requirements without affecting the basic manufacturing requirements or performance and cost advantages of the invention.

I claim:

1. A method of making a fuse element subassembly comprising the steps of:

providing a support means of insulating material;

providing said support means with metallized areas so that said support means has a least two separate metallized areas; and printing a metallo-organic ink on said support means and firing to provide a thin film fusible element on said support means to electrically connect said metallized areas.

2. A method of making a fuse subassembly as in claim 1 wherein said support means is selected from a group comprised of ceramic, glass, alumina and forstreite.

3. A method of making a fuse element subassembly as in claim 1 wherein said support means is capable of withstanding a temperature required to fire the thin film fusible element.

4. A method of making a fuse element subassembly as in claim 1 wherein said support means has a surface finish smoother than 2–3 micro-inches.

5. A method of making a fuse element subassembly as in claim I wherein said support means is glazed ceramic.

6. A fuse element subassembly comprising:

a support means of insulating material;

at least two metallized areas on said support means; and a fired metallo-organic thin film ink fusible element on said support means electrically connecting said metallized areas.

7. A fuse element subassembly as in claim 6 wherein the thickness of said fusible element varies inversely with irregularities on the surface of said support means.

8. A fuse element subassembly as in claim 6 wherein said support means is selected from a group comprised of ceramic, glass, alumina and forsterite.

9. A fuse element subassembly as in claim 8 wherein said support means has a surface finish smoother than 2–3 micro inches.

10. A fuse element subassembly as in claim 6 wherein a coating material of low thermal conductivity is applied between said support means and said thin film element.

11. A fuse element subassembly as in claim 6 wherein said support means is glazed ceramic.

12. A fuse element subassembly as in claim 6 wherein said fusible element is less than 100 micro inches thick.

13. A fuse element subassembly as in claim 11 wherein said fusible element is less than 100 micro inches thick.

14. A fuse element subassembly as in claim 6 wherein said fusible element has a sheet resistivity of between 100–1000 microohms per square.

* * * * *